US005367982A

United States Patent [19]

DeMoore et al.

[11] Patent Number: 5,367,982

[45] Date of Patent: Nov. 29, 1994

[54] AUTOMATIC COATING CIRCULATION AND WASH-UP SYSTEM FOR PRINTING PRESSES

[75] Inventors: Howard W. DeMoore, 10954 Shady Trail, Dallas, Tex. 75220; David D. Douglas, Garland; Steven M. Person, Seagoville, both of Tex.

[73] Assignee: Howard W. DeMoore, Dallas, Tex.

[21] Appl. No.: 22,515

[22] Filed: Feb. 25, 1993

[51] Int. Cl.[5] ..... B05C 11/02

[52] U.S. Cl. ..... 118/46; 118/203; 118/259; 118/302; 101/424; 101/425; 101/350; 101/366

[58] Field of Search ..... 101/350, 366, 424, 425; 118/46, 203, 259, 261, 302

[56] References Cited

U.S. PATENT DOCUMENTS

| | | | |
|---|---|---|---|
| 3,025,793 | 3/1962 | Vischulis | 101/350 |
| 3,740,173 | 6/1973 | Nateison | 417/475 |
| 3,896,730 | 7/1975 | Garrett et al. | 101/425 |
| 4,250,211 | 2/1981 | Damrau et al. | 427/356 |
| 4,369,734 | 1/1983 | Preuss | 118/203 |
| 4,395,968 | 8/1983 | Wahnschaff et al. | 118/602 |
| 4,440,809 | 4/1984 | Vreeland | 427/356 |
| 4,497,250 | 2/1985 | Dressler | 101/350 |
| 4,527,479 | 7/1985 | Dahlgren et al. | 101/450.1 |
| 4,534,291 | 8/1985 | Sabota et al. | 101/426 |
| 4,690,055 | 9/1987 | Fadner et al. | 101/451 |
| 5,003,877 | 4/1991 | Yano et al. | 101/425 |
| 5,005,478 | 4/1991 | Goldberg et al. | 101/425 |
| 5,010,817 | 4/1991 | Grosshauser | 101/366 |
| 5,103,730 | 4/1992 | Sarda | 101/425 |
| 5,206,470 | 5/1993 | Johnson | 101/425 |

FOREIGN PATENT DOCUMENTS 60-196348 10/1985 Japan ..... 101/366

*Primary Examiner*—W. Gary Jones
*Assistant Examiner*—John Hoffman
*Attorney, Agent, or Firm*—Dennis T. Griggs

[57] ABSTRACT

A coater assembly includes a feed pump and a return pump for circulating a liquid coating material through a doctor reservoir for applying protective or decorative coating material to freshly printed sheets in an offset rotary printing press. A portable console control unit includes circulation and wash-up components for operating the coater in a PURGE/replenishment mode, a COAT mode, a WASH mode and a DRAIN mode. The components for pumping and valving the coating liquid and cleaning liquid are integrated within the portable console unit, which may be remotely located with respect to the press. Cleaning liquid and waste materials are stored internally within the portable console unit. The various operating modes are coordinated by two position, three-port flow control valves which are actuated from one position to the other by electrical solenoids under the control of ON-OFF switches. The ON--OFF switches may be actuated manually, or automatically by a cyclic controller for providing PURGE, COAT, WASH and DRAIN modes. The system may be cleaned without removing the coater or coater parts from the press, and without exposing press personnel to potentially toxic waste materials. The coater assembly may be operated in combination with the plate, blanket or delivery/transfer cylinder.

2 Claims, 8 Drawing Sheets

| PURGE | COAT | WASH | DRAIN |
|---|---|---|---|
| S1 ON | S1 ON | S1 ON | S1 ON |
| S2 OFF | S2 OFF | S2 OFF | S2 ON |
| S3 OFF | S3 OFF | S3 ON | S3 OFF |
| S4 ON | S4 OFF | S4 ON | S4 ON |

| | Q1 | Q2 | S1 | V5 |
|---|---|---|---|---|
| PURGE | $\overline{SW}$ | SW | ON | OPEN |
| COAT | $\overline{SW}$ | $\overline{SW}$ | ON | OPEN |
| WASH | SW | SW | ON | OPEN |
| DRAIN | SW | SW | ON | CLOSED |

AUTOMATIC COATING CIRCULATION AND WASH-UP SYSTEM FOR PRINTING PRESSES

FIELD OF THE INVENTION

This invention relates to sheet-fed, rotary offset printing presses, and in particular to a system for circulating a liquid material such as protective/decorative coating or liquid ink through a coater unit, and including apparatus for automatically purging, washing and draining the coater and circulation system.

BACKGROUND OF THE INVENTION

In some offset printing applications, it is desirable that the press be capable of applying a protective and/or decorative coating over all or a portion of the surface of the printed sheets. Such coatings typically are formed of a UV-curable or water-soluble resin applied as a liquid solution or emulsion by an applicator roller over the freshly printed sheets to protect the ink and improve the appearance of the sheets. Use of such coatings is particularly desirable when decorative or protective finishes are required, for example in the production of posters, record jackets, brochures, magazines, folding cartons, labels and the like. Adhesive coatings are sometimes applied to folding cartons, record jackets and the like. In cases where a coating is to be applied, the coating operation is carried out after the final ink printing has been performed, usually by an in-line coater or by a separate coating unit located downstream of the last printing station so that the coating is applied to the sheets after final printing, but before the sheets have reached the sheet delivery stacker.

DESCRIPTION OF THE PRIOR ART

When the coater is to remain idle for an extended period between jobs, or at the end of the work day, the coating should be drained from the coating apparatus, and all coater components and flow lines should be thoroughly cleaned, using a solvent or detergent solution and rags. Typically, the supply and return lines must be flushed, the coater must be flushed and hand cleaned, and the coating roller or rollers and reservoir pan must be cleaned manually. It will be appreciated that a substantial amount of press down time is involved during the manual cleaning of the coater components. The manual cleaning task requires the coater to be removed from the press to provide clean-up access to internal components. Moreover, the internal surfaces of the doctor blade cavity are difficult to reach with a cleaning rag, with the result that the reservoir cavity may become contaminated with a sticky coating residue which gradually builds up and may contaminate the coating liquid during subsequent press runs. The time spent in cleaning the coater is non-productive time and therefore there has been a long-felt need for a system to reduce the wash-up time between jobs.

After extended press runs, ink residue and airborne dirt particles, spray powder and the like sometimes accumulate on the coater, for example on the coating roller and within the coating reservoir. Consequently, it is necessary to remove contaminated coating liquid from the coating reservoir from time to time and to replace it with fresh, clean coating liquid. Such cleaning operations require the press to be shut down for an extended period of time while the coating unit is removed from the press so that the contaminated coating material may be removed and the wettable surfaces cleaned, and then re-installed on the press.

ADVANTAGES OF THE INVENTION

The present invention provides a coater assembly which performs conventional coating operations, and which is self cleaning and does not require manual effort by press personnel. The coater components may be cleaned and drained using only a cleaning liquid and air while the coater remains attached to the press, and does not require disassembly/removal and reassembly of the coater for manual cleaning by rags, or by a brush within a cleaning sink. Cleaning operations are performed more completely and more thoroughly than could be achieved by the conventional manual method using cleaning rags.

The coater assembly is capable of cleaning operation with only water as the cleaning solution, and is simple to construct and install. The same pumps are used for circulating the cleaning water, as well as for circulating the coating liquid, with the supply and return lines, valves and pumps which circulate the coating liquid and water all being thoroughly drained, cleaned and renewed simultaneously with the cleaning of the coater head and anilox roller, thus preventing the progressive build-up of sticky residue which usually occurs in the coating components of such systems.

The valving, pumping and storage means for handling both the coating liquid and the cleaning water lends itself to simple and easy remote control of circulation valves and pumps. The coater assembly employs two position, three-port control valves to effect different operating modes (PURGE, COAT, WASH, DRAIN) which may be actuated either electrically or pneumatically under the control of simple push button switch circuitry, or under the control of automatic sequencing means.

It will be appreciated that the wash-up method and apparatus of the present invention is safer to operate as compared with the conventional method of disassembly/removal/reassembly of the coater for manual cleaning with rags. Because it is not necessary to disassemble or remove the coater while performing any of the operating modes, press personnel are not exposed to the cleaning solvents and waste materials. Moreover, misalignment of the coater and incorrect installation problems are completely avoided, including unnecessary exposure of press personnel to contact with rotating machinery during disassembly, removal and reinstallation.

SUMMARY OF THE INVENTION

The foregoing advantages are provided according to the present invention by a coater assembly which includes a pump for circulating liquid coating material through a doctor reservoir during PURGE/replenishing and COAT operations, and for circulating cleaning water and/or air through the doctor reservoir during a WASH cycle or during a DRAIN cycle. According to an important aspect of the invention, the valving, pumping and storage of both the coating liquid and cleaning liquid are integrated within a portable console unit which may be remotely located with respect to the press. The various operating modes are coordinated by two position, three-port circulation valves which are actuated by electrical solenoids under the control of simple push button switches. The push button switches may be actuated manually to provide for PURGE, COAT, WASH and DRAIN. Alternatively, the control circuits may be operated by cyclic control means and servo motors for automatic sequencing of the control valves and pump motor from an initial condition, with the actuation of a single push button switch being all that is required to initiate any one of the operating modes for a predetermined duty cycle.

Other features and advantages of the present invention will become apparent from the following detailed description taken in conjunction with the accompanying drawings which disclose, by way of example, the principles of the invention.

DETAILED DESCRIPTION OF THE PREFERRED EMBODIMENT

Figure 1:
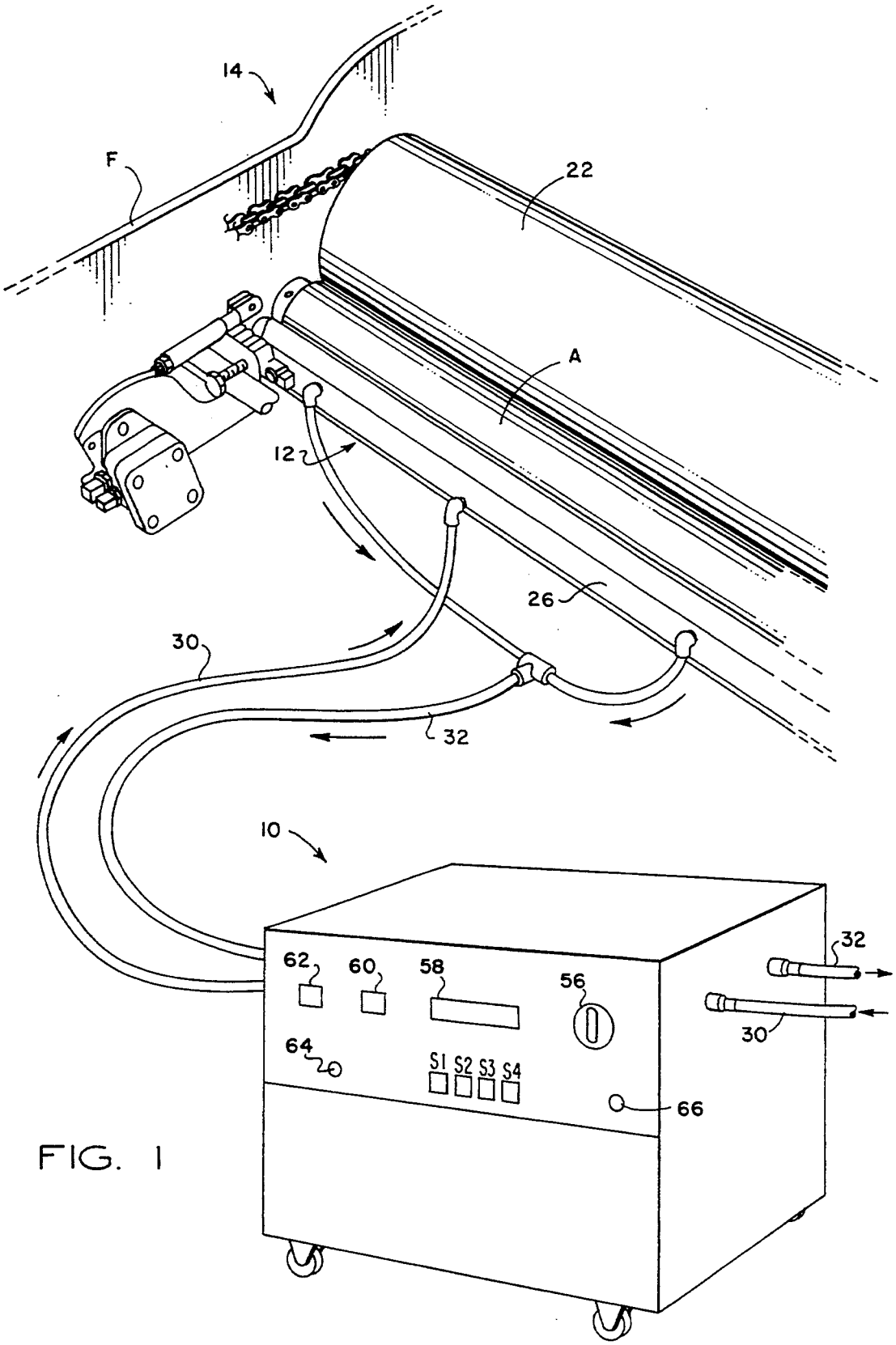
FIG. 1 is a perspective view showing the coating apparatus of the present invention in combination with an offset printing press and illustrating the fluid path of coating material from a remote console unit to the doctor blade reservoir of the coating apparatus.

In the description which follows, like parts are indicated throughout the specification and drawings with the same reference numerals respectively. The drawings are not necessarily to scale, and the proportions of certain parts have been exaggerated for purposes of clarity.

Operation of the exemplary embodiments is described with reference to a protective and/or decorative liquid coating material. However, it should be understood that the embodiments of the invention may be used to good advantage in combination with other coating materials, for example liquid adhesives. Moreover, the coating apparatus may also be used for applying ink.

While water is preferred as a cleaning fluid, it will be understood that other cleaning fluids, including liquid solvents, capable of washing away or dissolving the residual coating material in the reservoir and in the circulation conduits may be used to good advantage. Where a chemical solvent is used, the waste material may be processed and reclaimed or collected for treatment so that it may be safely discharged into a sewer.

Referring now to FIG. 1, a portable control console 10 is coupled in fluid communication with an in-line doctor blade apparatus 12 for use in applying a protective and/or decorative liquid coating material to a freshly printed surface in a sheet-fed or web-fed, rotary offset or flexographic printing press. In this instance, the doctor blade coating apparatus 12 is installed in the final press unit of a four color printing press, such as that manufactured by Heidelberger Druckmaschinen AG of the Federal Republic of Germany under its designation Heidelberg Speedmaster 102V (40 inch). The press includes a press frame F which supports the printing components of four substantially identical sheet printing units which can print different color inks onto the sheets S as they are individually and sequentially fed into the press at one end, and which includes a sheet delivery stacker in which the finally printed sheets S are collected and stacked at the opposite end.

Figures 2, 3:
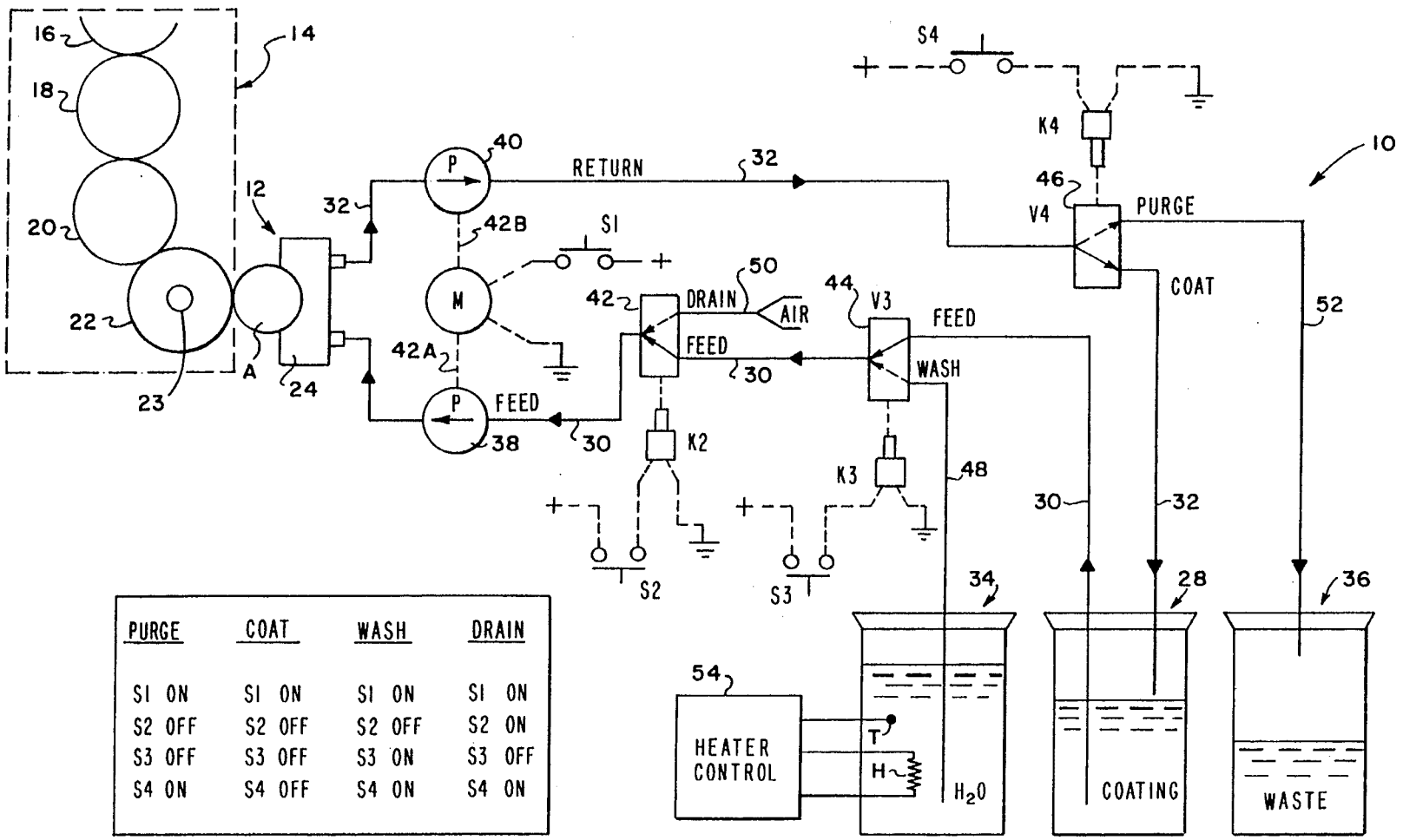
FIG. 2 is a simplified schematic diagram of the manual sequencing embodiment of the coating apparatus shown in FIG. 1.
FIG. 3 is an instruction table showing the required switch settings for implementing PURGE, COAT, WASH and DRAIN operations.
Figure 4:
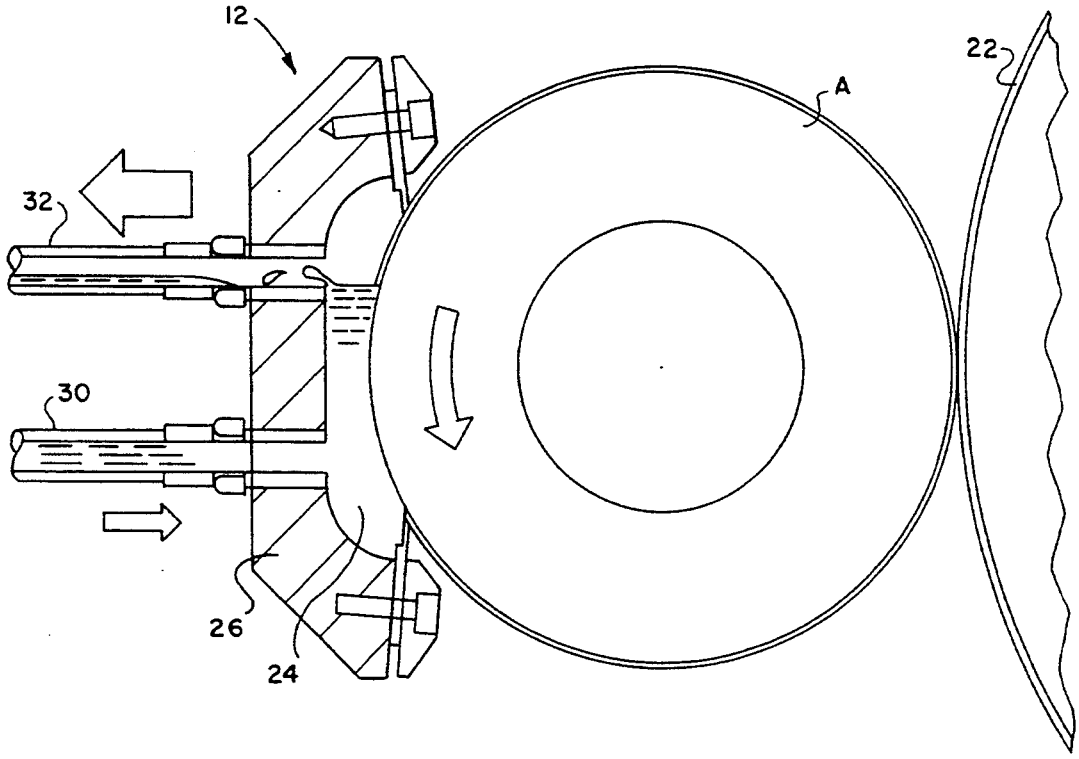
FIG. 4 is a simplified schematic diagram showing the flow of coating liquid to and from a coating application roller.

Referring now to FIG. 3, printing unit 14 is of conventional design, including a plate cylinder 16, a blanket cylinder 18 and an impression cylinder 20. The protective or decorative liquid coating material is applied by an auxiliary blanket cylinder 22, which also functions as a transfer/delivery cylinder, which is mounted on the transfer/delivery cylinder drive shaft 23. A protective and/or decorative coating is applied by an application roller A to the auxiliary blanket 22, which in turn applies it to the freshly printed sheet. The in-line coating apparatus 12 is shown in FIG. 1 and FIG. 4. Liquid coating material L is picked up by the applicator roller A which preferably is an anilox roller having an engraved surface which is designed to pick up a predetermined uniform thickness of liquid material from the doctor reservoir 24, and then uniformly transfer the coating material to the surface of the blanket cylinder 22.

The doctor reservoir cavity 24 is formed within an elongated doctor blade head 26 having a generally C-shaped cross section with an opening extending longitudinally along one side facing the applicator roller A. The reservoir 24 is supplied with liquid coating material from a supply drum 28 through feed and return conduits 30, 32, respectively, which provide for circulation of liquid coating material from the remote drum 28 to circulation control valves within the console 10, and to and from the doctor reservoir 24.

Figure 6:
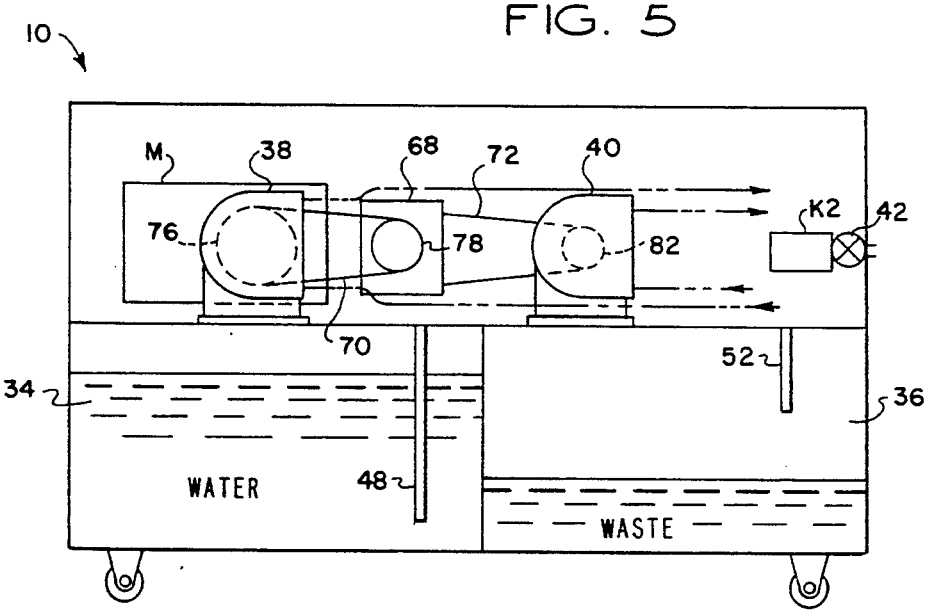
FIG. 6 is an elevational view, partially in section, of the control console showing the relative positions of pumping components, cleaning water reservoir and waste water reservoir.

Referring now to FIG. 2, the remote supply drum 28 along with a clean water supply reservoir 34 and a waste dump reservoir 36 are shown diagramatically. Preferably, the clean water reservoir and the waste dump reservoir are located within the portable console 10, as shown in FIG. 6.

A feed pump 38 and a return pump 40 are provided for circulating the liquid coating material and cleaning water from the storage reservoirs to the doctor reservoir 24 and return. Preferably, the pumps 38, 40 are peristaltic pumps which do not draw air into the circulation line. The pumps 38, 40 are driven by an electric drive motor M which is mechanically coupled in concurrent driving relation to the pumps by rotor drive shafts 42A, 42B, respectively. The electric motor M is energized ON by a source of electrical current through a single pole, single throw switch S1.

Figure 12:
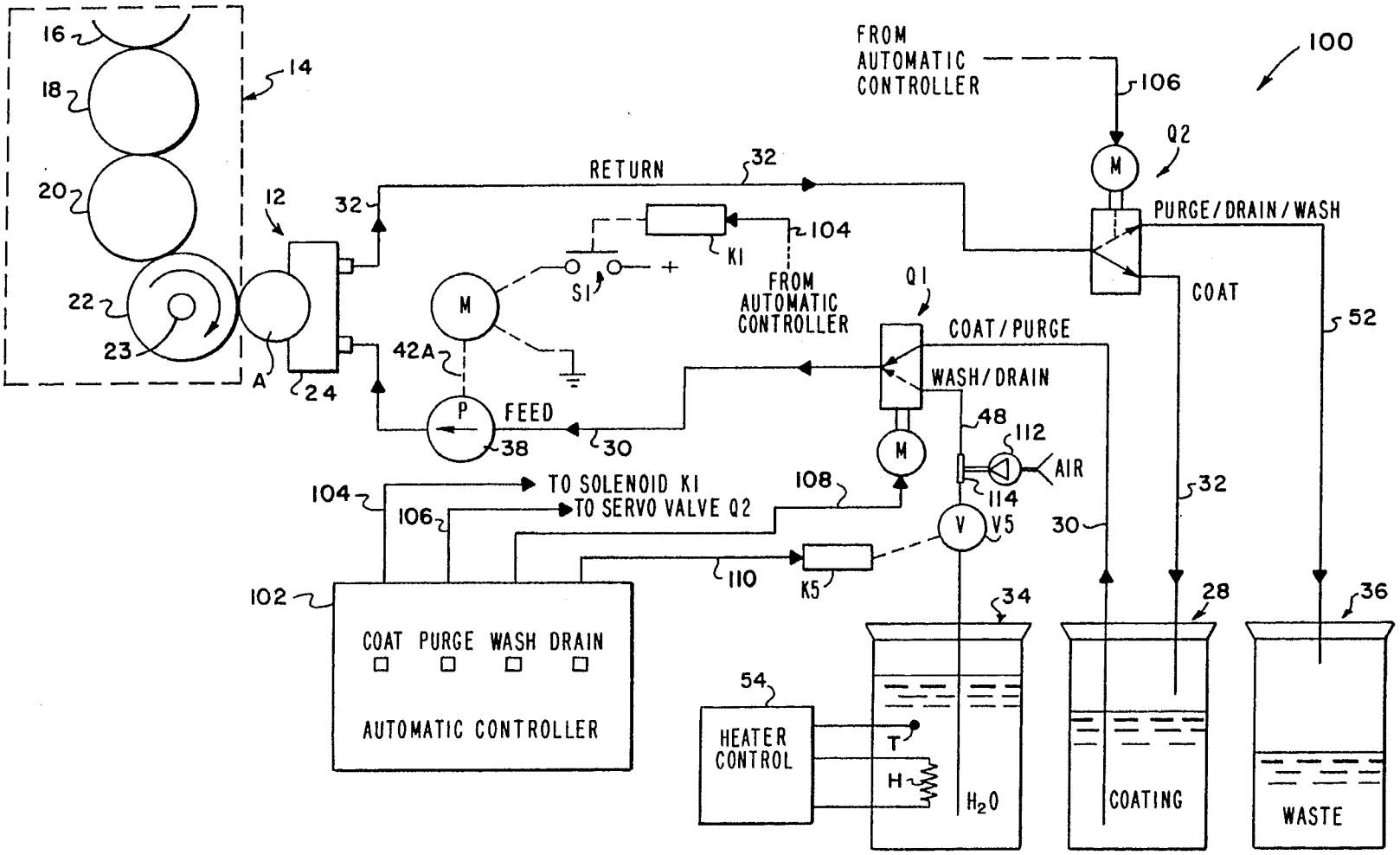
FIG. 12 is a simplified schematic diagram of an alternative automatic sequencing embodiment of the coating apparatus shown in FIG. 1, in which circulation of liquid materials is provided by a single pump in a positive feed arrangement; and, FIG. 13 is a simplified schematic diagram of an alternative automatic sequencing embodiment of the coating apparatus shown in FIG. 1 in which liquid material is circulated by a single pump in a suction flow arrangement.
Figure 13:
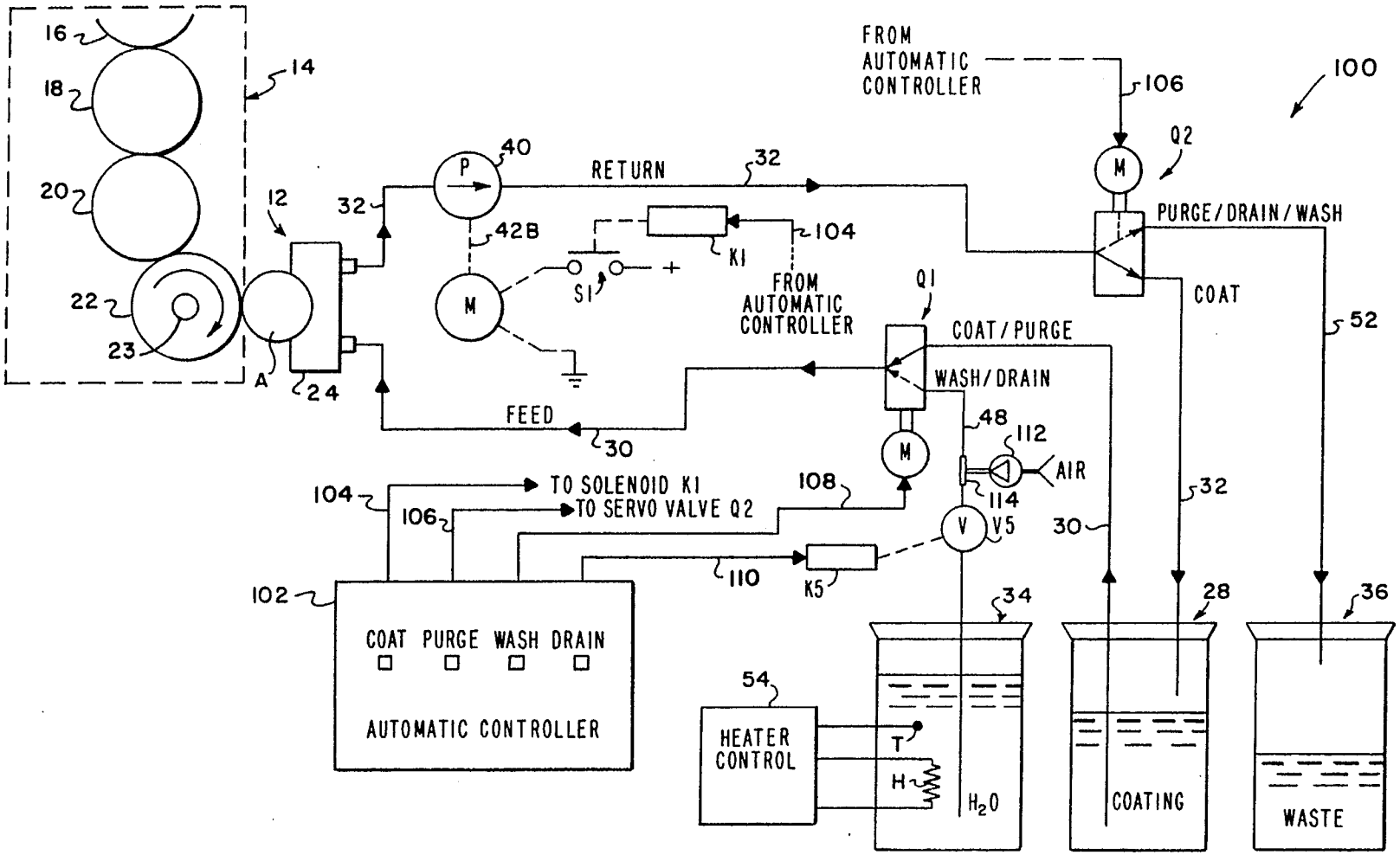

Two pumps, one in the feed conduit 30 and one in the return conduit 32, are preferred for adjusting the rate at which liquid material is supplied to and returned from the coater reservoir 22. However, it should be understood that the circulation system of the invention may be operated satisfactorily with only a single pump, either in the feed conduit 30 or in the return conduit 32. Referring to FIG. 12, a single pump 38 is connected in the feed conduit 30, and the coater reservoir 22 is pressurized with liquid material at an internal positive pressure which is greater than atmospheric pressure. Referring to FIG. 13, a single pump 40 is connected in the return conduit 32, and liquid material is supplied to the coater reservoir 22 by suction flow through the feed conduit 30, with the internal pressure of the coater reservoir 24 being maintained at a pressure level less than atmospheric pressure. All three pumping arrangements may be utilized to achieve the advantages and objects of the present invention.

For the purpose of controlling the flow of liquid coating material or cleaning fluid through different flow circulation circuits corresponding with PURGE, COAT, WASH and DRAIN, respectively, a set of flow control valves 42, 44 and 46 are interconnected with the feed and return conduits 30, 32, together with a wash water conduit 48, an air inlet port 50 and a drain conduit 52. The valves are actuated by electrical solenoids K2, K3 and K4, respectively. The control valves 42, 44 and 46 are shown in the de-energized state and the control switches are shown in the OFF position. Upon closure of a control switch, the control valve shuttles to the position indicated by the dashed arrow which provides the appropriate flow path for the function selected.

The valves 42, 44 and 46 are conventional two position, three-port flow valves, commonly referred to as a three-way valve. Control valves 42, 44 are each connected so as to provide a single outlet port with alternative inlet ports. The flow control valve 46 is connected so as to have a single inlet port with alternative (switched and unswitched) outlet ports. Thus, the flow control valve 42 has a first (unswitched) inlet port connected to the feed conduit 30 and a second (switched) inlet port connected to the air inlet port 50. The unswitched and switched positions are indicated by solid and dashed arrows, respectively. According to this arrangement, the control valve 42 will conduct liquid flow through its outlet port to the inlet of the feed pump 38 when the solenoid K2 is de-energized (switch S2 in the OFF position) and will conduct ambient air through the air inlet port 50 to the input of the feed pump 38 for the purpose of draining the system when the switch S2 is pressed ON and the solenoid K2 is energized. The switched position of the control valve 42 is indicated by the dashed arrow.

The control solenoid 44 has its unswitched inlet port connected to the feed conduit 30 and its switched inlet port connected to the wash water conduit 48. Thus, the control flow valve 44 will feed liquid coating material from the supply drum 28 to the unswitched inlet port of the first flow control valve 42 when switch S3 is in its OFF position (solenoid K3 de-energized). Upon closure of control switch S3, solenoid K3 is energized ON, and the control valve 44 switches to the position shown by the dashed arrow so that clean wash water may be pumped from the cleaning water reservoir 34 for circulation through the flow lines and doctor reservoir 24.

The flow control valve 46 is connected to permit liquid material circulation when the control switch S4 is OFF, and PURGE operation when control switch S4 is ON. The inlet port of the control switch 46 is connected to the outlet of the return pump 40 for circulating return flow through the conduit 32. When the control switch S4 is OFF, the flow through the control valve 46 is discharged from the unswitched outlet port through the return conduit 32 into the remote coating storage drum 28. Upon closure of switch S4, the control valve 46 shifts to the position indicated by the dashed arrow, thus delivering its output from the switched outlet port through the drain conduit 52 for dumping into the waste reservoir 36.

The various switch combinations required to produce a specific operating mode are indicated in FIG. 3. For example, to select the COAT operating mode, it is only necessary to actuate control switch S1 to the ON position, with the control switches S2, S3 and S4 remaining in the OFF position. When control switch S1 is actuated, the drive motor M is operated to drive the feed and return pumps 38, 40. Coating liquid is pumped from the remote drum 28 through the circuit provided by the feed conduit 30, the control valve 44 and the control valve 42. Coating liquid is returned from the doctor reservoir 24 by the return pump 40 through the circuit established by the return conduit 32, the control valve 46 and the terminal end portion of the return conduit 32.

When it becomes necessary to purge liquid material from the doctor reservoir 24, for example at the beginning of a work day, or when contamination is detected during a coating run, control switch S4 is turned ON and coating liquid is circulated through control valve 44, control valve 42, feed pump 38, doctor reservoir 24, return pump 40 and return conduit 32 to the inlet port of the control valve 46. The unused or contaminated coating contents of the doctor reservoir 24 are then dumped through the purge conduit 52 into the waste reservoir 36, and the doctor reservoir 24 is replenished with fresh coating material.

At the conclusion of a coating run, for example, at the end of the working day, the doctor reservoir 24 and the circulation conduits 30, 32 may be thoroughly cleaned along with the anilox roller 20 without removing the coater from the press simply by turning control switches S1, S3, and S4 to the ON position, with control switch S2 remaining in the OFF position.

During the WASH mode of operation, warm cleaning water is pumped from the water reservoir 34 through the wash inlet port of the control valve 44, through the control valve 42 which is in the de-energized position, through the feed pump 38, doctor reservoir 24 where it is returned through the conduit 32 by the pump 40 to the inlet port of the control valve 46. Since control switch S4 is ON, the mixture of cleaning water and coating material is discharged through its PURGE port where it is dumped into the waste reservoir through the drain conduit 52.

As shown in FIG. 2, the cleaning water is heated by a resistance heater H. The temperature of the water is sensed by a thermistor T, which is input to a heater control circuit 54. The heater control circuit 54 is adjusted to maintain a water temperature within a desired range, for example 100° F.–150° F.

Typically, after a WASH operation, it is desirable to drain the system. System DRAIN is performed by pushing control switches S1, S2 and S4 ON with control switch S3 remaining OFF. In that configuration, both pumps 38, 40 are operating, and the control valve 46 is switched to the PURGE position. The status of control valve 44 has no effect in the DRAIN configuration since its output is connected to the non-selected feed input of the control valve 42. Upon actuation of control switch S2, the control valve 42 switches to the dashed arrow position, thus permitting air to be pumped through the air inlet port 50 through the feed conduit 30 and into the doctor reservoir 24. The air flow is sufficient to displace residual water out of the flow lines and doctor reservoir. The residual water is dumped through the purge conduit 52 into the waste reservoir 36.

Figure 7:
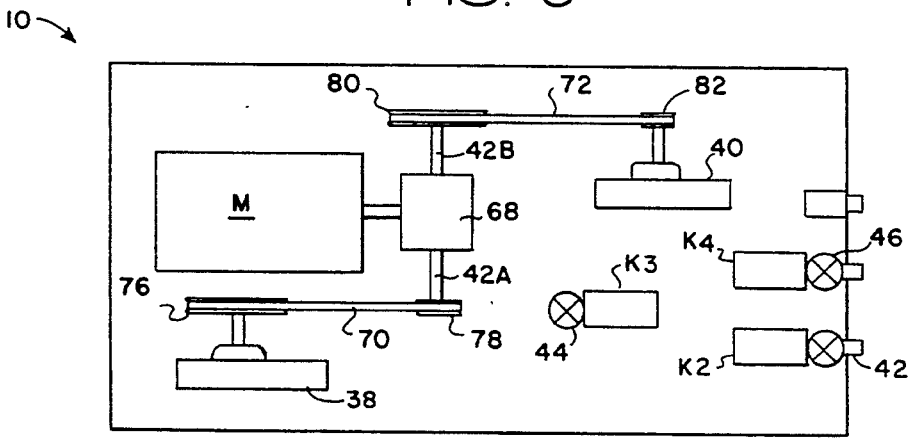
FIG. 7 is a top plan view of the control console.

For the purpose of actuating the control switches S1, S2, S3 and S4 in various combinations to establish the operating modes indicated in FIG. 3, a simple manual control circuit as shown in FIG. 2 may be employed or, alternatively, a cyclic control device as shown in FIG. 7, either electromechanical or solid state, may be used to provide completely automatic operation. That is, at the end of a coating run, or at the end of a work day, when it is desired to clean and drain the system, the WASH mode is selected by manually pushing the switches S1, S3 and S4 to the ON position (S2 OFF) and leaving them in the ON position for a predetermined period of time. Next, switches S1, S2 and S4 are pushed ON (S3 OFF), thus initiating the DRAIN mode for a predetermined period of time. Both procedures require operator attention and supervision.

Referring again to FIG. 1, the control switches S1, S2, S3 and S4 are preferably clustered on the operating panel of the console control unit 10. The console control unit 10 includes a master power switch 56, a water temperature digital display 58, a heater switch 60 and a pump override switch 62. If the control unit 10 is equipped with a cyclic controller for providing completely automatic sequencing operation, the push buttons which correspond with switches S1, S2, S3 and S4 may instead be designated "PURGE", "COAT", "WASH" and "DRAIN", respectively. Other visual indicators, for example a low water warning light 64 and a power ON light 66 are provided for the convenience of the press operator.

Figure 5:
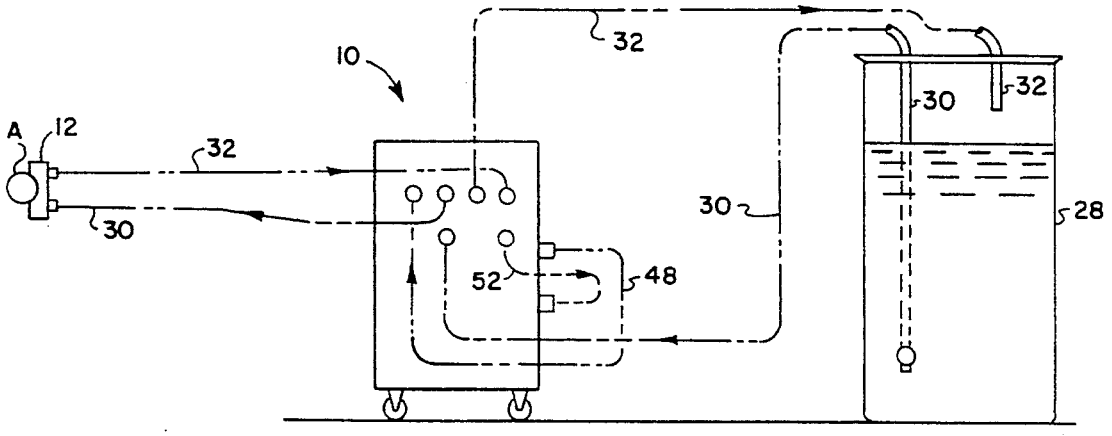
FIG. 5 is a simplified schematic diagram showing the flow of coating liquid from a coating liquid supply reservoir through the control console of the present invention to a coating applicator roller.

Referring now to FIG. 5 and FIG. 6, the drive motor M is coupled to the feed pump 38 and the return pump 40 through a gear reducer 68, drive belts 70, 72 and coupling pulleys 76, 78 and 80, 82, respectively. According to this arrangement, both pumps are operated by a single drive motor, with the pumping speed being adjusted appropriately by the gear reducer 66 and the pulley ratios. Remote actuation by the press operator of the four push button switches S1, S2, S3 and S4 achieves the primary benefits of the invention which is the elimination of manual cleaning employing rags and the like, and without requiring removal of the coater or coater components from the press and reinstallation thereof.

If an automatic control circuit 100 is used, for example as shown in FIG. 7, FIG. 12 and FIG. 13, it is only necessary for the operator to push a single button to initiate the PURGE mode for a predetermined duty cycle followed automatically by the WASH and DRAIN modes of operation for a predetermined duty cycle. That is, in the automatic operating mode, the operator need only press a single button, and the system cycles automatically from one selected mode to another to system OFF. The PURGE operating mode may be engaged manually at any time contamination of the coating liquid is detected.

Figures 8, 9:
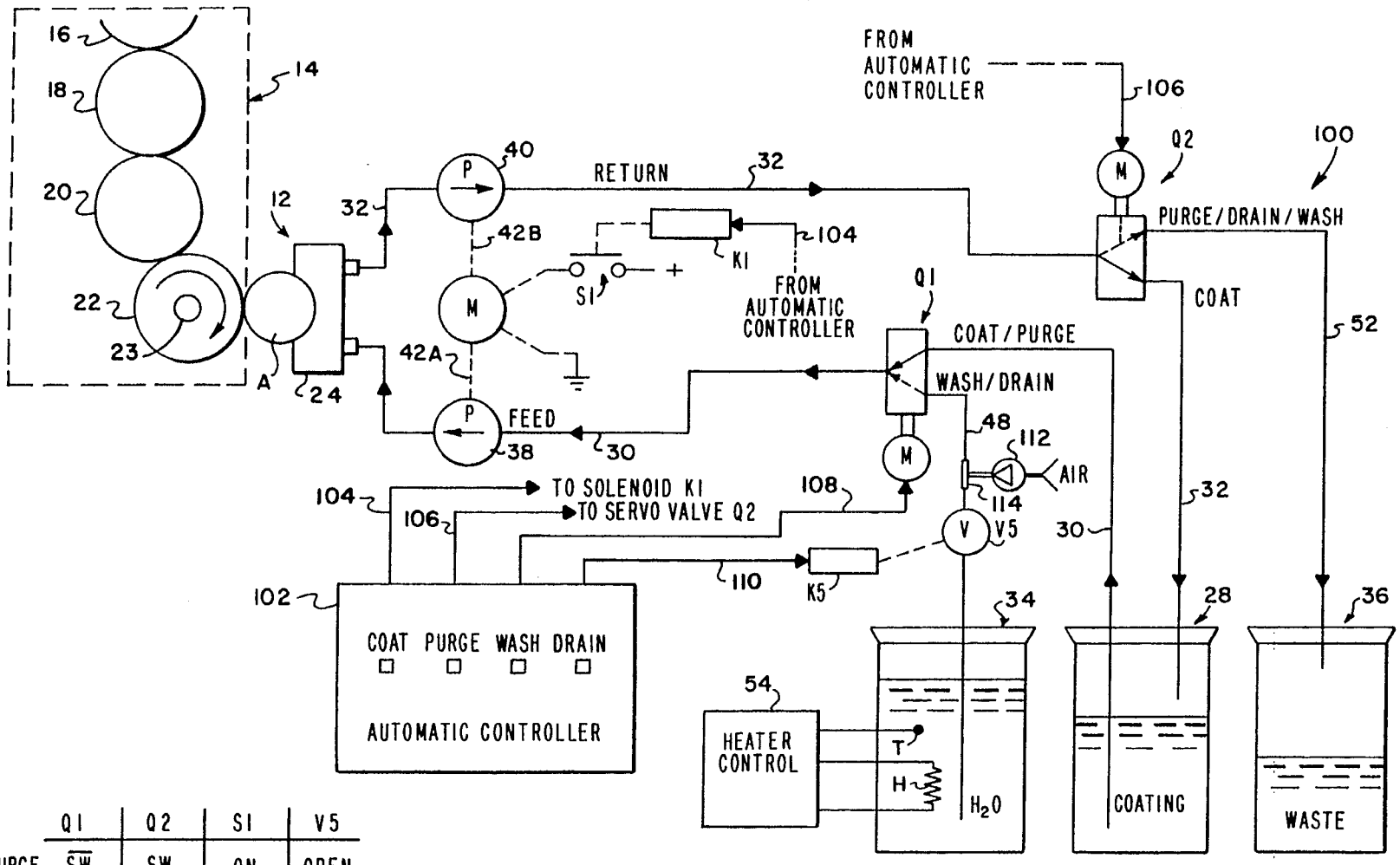
FIG. 8 is a simplified schematic diagram of the automatic sequencing embodiment of the coating apparatus shown in FIG. 1.
FIG. 9 is an instruction table showing the operating status of the various control components of the automatic system of FIG. 8 for implementing PURGE, COAT, WASH and DRAIN operations.

Operation of the automatic control circuit 100, as shown in FIG. 8, is coordinated by first and second servo actuated flow control valves Q1, Q2, and by an automatic controller 102. The automatic controller includes push button switches designated "COAT", "PURGE", "WASH" and "DRAIN". The automatic controller 102 includes a programmable memory which generates control signals 104, 106, 108 and 110 for controlling the operation of the solenoid K1, the servo drive motor M of control valve Q2, the servo drive motor M of the control valve Q1 and a solenoid K5 which controls a normally open flow valve V5. The operating program within the automatic controller 102 produces the appropriate combination of control signals according to the selected operating mode as shown in the instruction table of FIG. 9. In FIG. 9, "SW" and "$\overline{SW}$" refer to the switched (dashed arrow) and unswitched (solid arrow) positions of servo valves Q1, Q2 respectively.

In the PURGE operating mode, servo flow valve Q1 is in the unswitched position as shown by the solid arrow, and the servo flow valve Q2 is in the switched position as shown by the dashed arrow. This permits the flow of coating liquid from the coating reservoir 28 through the pump 38, coater 12, pump 40, for return through the return conduit 32 through the servo control flow valve Q2 into the waste collection reservoir 36.

In the DRAIN operating mode, both servo control valves Q1, Q2 are in the switched positions and the control valve V5 is closed. Upon closure of valve V5, air is admitted through a one-way check valve 112 which is coupled in the flow conduit 48 by a T coupling 114. The one-way check valve 112 is blocked during COAT, PURGE and WASH operations by the reverse pressure differential condition which arises as a result of the positive pressure of water flow through the conduit 48 relative to ambient pressure across the check valve 112.

If automatic sequencing means are utilized, as shown in FIG. 8, FIG. 12 and FIG. 13, the pump apparatus may be operated and the control valves may be sequenced from a referenced operating condition to a subsequent operating condition without any care or attention on the part of the operator and with the operator being required only to initiate the sequence by pressing ON a single push button. For example, such an automatic control operation may be carried out in connection with the PURGE operating mode followed by the COAT operating mode and in the PURGE operating mode followed by the WASH and DRAIN operating modes. Such an automatic control arrangement may be provided by a series of wiper switches coupled to a common shaft which is adapted to turn ON the drive motors and corresponding solenoids in a predetermined sequence corresponding with first and second operating modes. It will be appreciated that the automatic control and sequencing of the valves and pumps is not limited to the use of wiper switches and that such control and sequencing may be carried out by solid state circuitry or even by pneumatic control means.

Such automatic control and sequencing will remove the burden of determining the length of the operating cycle from the press operator, and will permit the press operator to attend to other duties during automatic WASH/DRAIN cycles. Thus, in automatic operation, all the press operator is required to do to initiate a cleaning cycle is to momentarily depress an actuator button which causes the wiper switches to progressively advance from the WASH operating mode to the DRAIN operating mode, and finally turning off the pumps to system OFF upon conclusion of the DRAIN operating mode.

It is in this state that the automatic controller is left following completion of a coating run or at the end of a day's work. However, if the press operator should desire to refill the coater reservoir with coating liquid, the press operator would press the PURGE switch (S1), then after the PURGE cycle has been completed, press the COAT switch (switch S1), thereby initiating the COAT mode of operation.

During the WASH mode of operation, cleaning water is circulated through the doctor reservoir 24 which has the effect of simultaneously cleaning the applicator roller A at the same time the reservoir is cleaned. Preferably, the WASH cycle is continued until the wash return lines indicate that all coating material has been removed, thus indicating that all coating liquid has been removed from the doctor reservoir, anilox roller and circulation conduits. An auxilliary motor is provided for driving the anilox roller A while the press is stopped, and preferably at a speed sufficient to provide for agitation of the cleaning water within the doctor reservoir.

Figure 10:
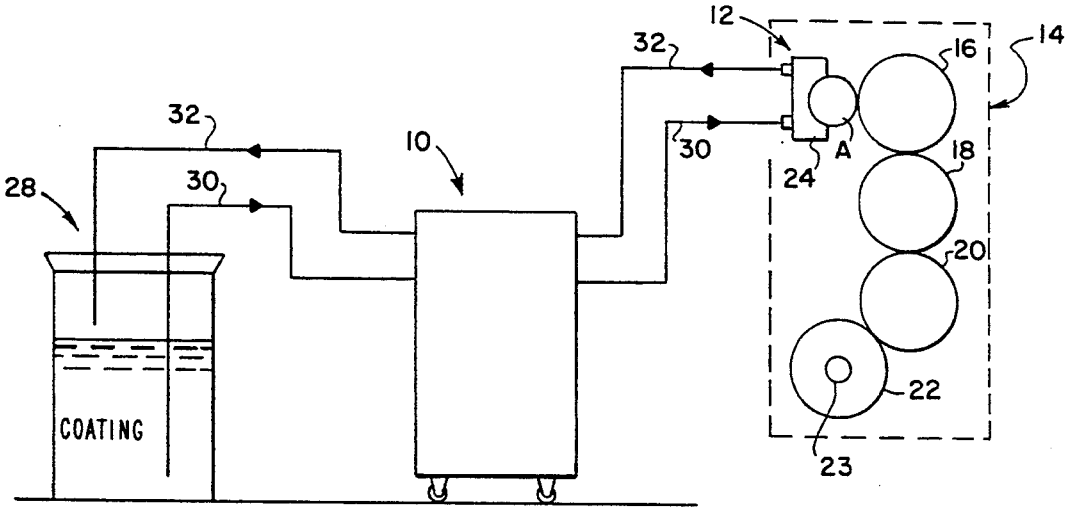
FIG. 10 is a simplified flow diagram in which the coater apparatus is installed in coating engagement with the plate cylinder of a printing unit.
Figure 11:
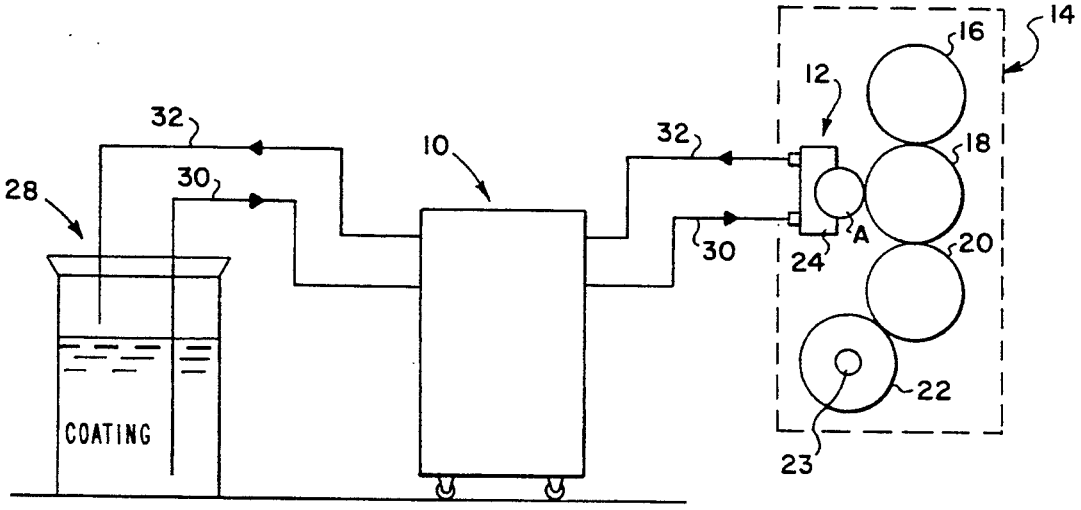
FIG. 11 is a view similar to FIG. 10 in which the coater apparatus is installed in coating engagement with the blanket cylinder of a printing unit.

The foregoing preferred embodiment has been described with the applicator roller being coupled in coating engagement with an auxiliary blanket roller which is installed in the delivery/transfer cylinder position of a printing press. However, the coater and circulation system may be used to good advantage with the applicator roller coupled in coating engagement with the plate cylinder 16, as shown in FIG. 10, or coupled in coating engagement with the blanket cylinder 18 as shown in FIG. 11, with the plate cylinder 16 and blanket cylinder 18 being shown in typical operating positions of an offset printing press.

It will be apparent that the coating circulation and wash-up system described above provides the advantages of the invention as stated. Regardless of whether the assembly is under remote control by manual push buttons as shown in FIG. 3, or fully automatic as shown in FIG. 8, FIG. 12 and FIG. 13, the task of removing the coater from the press and cleaning the doctor reservoir with rags has been completely eliminated. Moreover, any hazardous/toxic waste materials are safely contained for disposal, without exposure to the press personnel or to the press. It will be appreciated that the coating circulation and wash-up system of the present invention has universal application not only in presses of new design, but also in presses already in the field which may be retrofitted without making any modification whatsoever to the existing press or coater equipment. While a particular form of the present invention has been illustrated and described, it should be apparent that variations and modifications may be made therein without departing from the spirit and scope of the invention as set forth in the appended claims.

We claim:

1. Apparatus for selectively circulating liquid material from a coating liquid supply reservoir or from a cleaning liquid supply reservoir to a coater reservoir and for selectively returning liquid material from the coater reservoir to the coating liquid supply reservoir or to waste handling apparatus, comprising in combination:

a coater adapted for use in combination with a printing press, a coating liquid supply reservoir, a cleaning liquid supply reservoir and waste handling apparatus, said coater having a reservoir for receiving liquid material from a selected one of said supply reservoirs;

a supply conduit coupled in flow communication with the coater reservoir;

a return conduit coupled in flow communication with said coater reservoir;

pump apparatus coupled to at least one of said conduits for feeding liquid material from a selected one of said supply reservoirs to said coater reservoir and for returning liquid material from said coater reservoir through said return conduit;

first valve means coupled in flow communication in the supply conduit for selectively feeding liquid material from said coating supply reservoir to said coater reservoir in a first operating mode and for selectively feeding cleaning liquid material from the cleaning liquid supply reservoir to said coater reservoir in a second operating mode;

second valve means coupled in flow communication in the return conduit for selectively returning liquid material from said coater reservoir to said coating supply reservoir in the first operating mode and for discharging liquid material from said coater reservoir to said waste handling apparatus in the second operating mode;

said first valve means including first and second two-position, three port control valves, said first and second control valves each having switched and unswitched inlet ports and an outlet port, the outlet port of the first control valve being coupled to the inlet port of said pump apparatus, the unswitched inlet port of the first flow control valve being coupled in series with the supply conduit and the switched inlet port of the first flow control valve being coupled to admit ambient air; and, the outlet port of the second flow control valve being coupled in series flow relation with the unswitched inlet port of the first flow control valve, the unswitched inlet port of the second flow control valve being connected in series flow relation with the coating liquid supply reservoir, and the switched inlet port of the second flow control valve being coupled in flow communication with the cleaning liquid supply reservoir.

2. Apparatus for selectively circulating liquid material from a coating liquid supply reservoir or from a cleaning liquid supply reservoir to a coater reservoir and for selectively returning liquid material from the coater reservoir to the coating liquid supply reservoir or to waste handling apparatus, comprising in combination:

a coater adapted for use in combination with a printing press, a coating liquid supply reservoir, a cleaning liquid supply reservoir and waste handling apparatus, said coater having a reservoir for receiving liquid material from a selected one of said supply reservoirs;

a supply conduit coupled in flow communication with said coater reservoir;

a return conduit coupled in flow communication with said coater reservoir;

pump apparatus coupled to at least one of said conduits for feeding liquid material from a selected one of said supply reservoirs to said coater reservoir and for returning liquid material from said coater reservoir through said return conduit;

first valve means coupled in flow communication in the supply conduit for selectively feeding liquid material from said coating supply reservoir to said coater reservoir in a first operating mode and for selectively feeding cleaning liquid material from the cleaning liquid supply reservoir to said coater reservoir in a second operating mode;

second valve means coupled in flow communication in the return conduit for selectively returning liquid material from said coater reservoir to said coating supply reservoir in the first operating mode and for discharging liquid material from said coater reservoir to said waste handling apparatus in the second operating mode;

said first valve means including a first two-position, three port flow control valve, said first flow control valve having switched and unswitched inlet ports and an outlet port, the outlet port of the first flow control valve being coupled to the inlet port of said pump apparatus, the switched inlet port of the first flow control valve being coupled in flow communication with the cleaning liquid reservoir and the unswitched inlet port of the first flow control valve being coupled in flow communication with the coating liquid reservoir;

said second valve means comprises a second two-position, three port flow control valve, said second flow control valve having an inlet port and switched and unswitched outlet ports, the inlet port of the second flow control valve being connected in series flow relation with the return conduit, the unswitched outlet port of the second control valve being coupled in flow communication with the coating reservoir, and the switched outlet port of the second flow control valve being coupled in flow communication with said waste handling apparatus;

a feed conduit connecting the switched inlet port of the first flow control valve in flow communication with the cleaning liquid supply reservoir;

an ON/OFF flow control valve coupled in series flow relation in said feed conduit; and, a one-way check valve having an inlet port adapted to admit ambient air and having an outlet port coupled in flow communication with the switched inlet port of said first control valve.

* * * * *